US005146834A

United States Patent [19]

Izumisawa et al.

[11] Patent Number: 5,146,834

[45] Date of Patent: Sep. 15, 1992

[54] INTERPOLATING TONE WAVE GENERATOR HAVING TRUNCATED DATA

[75] Inventors: Gen Izumisawa; Yutaka Washiyama, both of Hamamatsu, Japan

[73] Assignee: Kabushiki Kaisha Kawai Gakki Seisakusho, Hamamatsu, Japan

[21] Appl. No.: 712,861

[22] Filed: Jun. 10, 1991

[30] Foreign Application Priority Data

Jul. 31, 1990 [JP] Japan ..... 2-201355

[51] Int. Cl.[5] ..... G10H 7/12

[52] U.S. Cl. ..... 84/607; 364/723

[58] Field of Search ..... 84/604–607, 84/622–625; 364/723, 724.1

[56] References Cited

U.S. PATENT DOCUMENTS 3,763,364 10/1973 Deutsch et al. ..... 84/604 X 4,646,608 3/1987 Deutsch ..... 84/623 X

*Primary Examiner*—Stanley J. Witkowski

[57] ABSTRACT

A tone generating apparatus comprises a wave memory, an address calculator, an interpolating circuit. In the wave memory is stored tone wave data of a single period to be repeatedly read out stored between a loop top address (integer address) and an address preceding by "1" a loop end address (integer address), same tone wave data as stored at the loop top address being stored at the loop end address. The address calculator generates a read address including a fraction portion, which sequentially increases from the loop top address of the wave memory toward the loop end address at an interval corresponding to a pitch, and returns to the loop top address when exceeding the loop end address. When the read address generated by the address calculator includes a significant fraction portion, the interpolating circuit prepares tone wave data acquired by proportional distribution of tone wave data, read out from the wave memory with an integer portion of the read address used as an address, and tone wave data, read out from the wave memory with a value acquired by adding "1" to the integer portion of the read address used as an address, using the fraction portion. Musical tones are generated on the basis of the tone wave data prepared by the interpolating circuit.

12 Claims, 9 Drawing Sheets

INTERPOLATING TONE WAVE GENERATOR HAVING TRUNCATED DATA

BACKGROUND OF THE INVENTION

1. Field of the Invention

The present invention relates to a tone generating apparatus for use in electronic musical instruments, such as a synthesizer, an electronic piano and an electronic organ. More particularly, this invention pertains to an interpolation process which is executed when tone wave data is read out from a wave memory incorporated in a tone generating apparatus.

2. Description of the Related Art

Recently, development of acoustic instruments, such as a piano and an organ, into electronic instruments has been active, providing electronic musical instruments, such as an electronic piano and electronic organ. In addition, a synthesizer which generates tones with a unique timbre has been realized as an electronic musical instrument.

These electronic musical instruments have a tone generating apparatus (tone generator) with an incorporated wave memory in which tone wave data is stored. The wave memory has multiple groups of tone wave data stored in association with respective timbres to permit generation of various timbres. One group of tone wave data consists of multiple pieces of tone wave data to generate a predetermined tone waveform.

In such a tone generating apparatus, when a predetermined timbre is specified by operating a panel switch, for example, one group of tone wave data is selected from the multiple groups of tone wave data stored in the wave memory. Each tone wave data constituting the selected group is read out at a speed corresponding to the pitch specified by a key. The read-out tone wave data is reproduced into a tone waveform by a waveform generator, and it is output as a tone wave signal to an acoustic circuit. Upon reception of this tone wave signal, the acoustic circuit drives loudspeakers, a headphone or the like in accordance with the tone wave signal, thereby releasing a musical tone.

Because of the limited capacity of the wave memory, the conventional tone generating apparatus employs the art of compressing tone wave data before storing it in the wave memory.

For instance, a group of tone wave data of a musical tone having a certain timbre is generated by cutting off the tone waveform for that timbre to a predetermined length (the tone waveform normally having multiple periods) and sampling the resulting tone waveform at given intervals for its digitization. Normally, the tone waveform is cut off to a predetermined length from the beginning of this tone signal because the attack portion of a musical tone often contains the characteristic of the timbre.

The digital tone wave data prepared in this manner is stored in the wave memory. The tone wave data stored is read out in a special manner described below, thus generating a musical tone.

To generate a musical tone with a certain timbre, a predetermined length of tone wave data stored in the wave memory (the predetermined length comprising a multi-period waveform) is defined by a loop top address LT and a loop end address LE (both being addresses in the wave memory) and the tone wave data is read out once from the top to the end (to the loop end address LE). Thereafter, the tone wave data in a region surrounded by the loop top address LT and loop end address LE is repeatedly read out. As a result, a sustaining tone waveform is reproduced and a tone signal is generated accordingly.

The pitch is controlled by the speed for reading tone wave data from the wave memory (i.e., read frequency or read speed). In this case, a circuit which alters the read speed of the wave memory in accordance with the pitch has a complicated structure and is therefore large. Further, since the read speed of the wave memory depends on the performance of the elements constituting the wave memory, it is limited.

Actually, a virtual sampling position in the wave memory space (address including a fraction portion in the wave memory), which corresponds to the read speed, is calculated, and, if the virtual sampling position does not match with the actual memory location (integer address) of the tone wave data, the tone wave data stored at addresses preceding and following the virtual sampling position are proportionally distributed to thereby compute tone wave data corresponding to the virtual sampling position. (This processing will be hereunder called "interpolation.") A tone waveform is reproduced on the basis of the thus calculated tone wave data, thereby providing a tone wave signal.

According to the tone generating apparatus with the above structure, however, the circuit for repeatedly reading out the tone wave data in the region surrounded by the loop top address LT and loop end address LE in the wave memory while executing interpolation, is complex and large. This inevitably increases the cost of the tone generating apparatus.

SUMMARY OF THE INVENTION

It is therefore an object of the present invention to provide a tone generating apparatus which has a smaller circuit scale for interpolation and can thus be manufactured at a lower cost.

To achieve this object, according to one aspect of the present invention, there is provided a tone generating apparatus comprising a wave memory having tone wave data of a single period to be repeatedly read out stored between a loop top address (integer address) and an address preceding by "1" a loop end address (integer address), wherein the same tone wave data that is stored at the loop top address is also stored at the loop end address; address generating means for generating a read address including a fraction portion, which sequentially increases from the loop top address of the wave memory toward the loop end address at an interval corresponding to a pitch, and returns to the loop top address when exceeding the loop end address; interpolating means for, when the read address generated by the address generating means includes a significant fraction portion, preparing tone wave data acquired by proportional distribution of tone wave data, read out from the wave memory with an integer portion of the read address used as an address, and tone wave data, read out from the wave memory with a value acquired by adding "1" to the integer portion of the read address used as an address, using the fraction portion; and tone generating means for generating a musical tone based on the tone wave data prepared by the interpolating means.

With the above structure, tone wave data of a single period to be repeatedly read out is stored between the loop top address and an address preceding by "1" the loop end address, and the same tone wave data that is stored at the loop top address is also at the loop end address. At the time a read address which sequentially increases from the loop top address of the wave memory toward the loop end address at an interval corresponding to a pitch, is generated, and tone wave data is read out to be interpolated with this read address having a significant fraction portion, it is unnecessary to determine whether or not the read address exists between the loop end address and the address preceding the loop end address by "1", so that interpolation can be executed using the tone wave data stored at integer addresses preceding and following the read address as in the case of carrying out interpolation at another position. In other words, no special hardware is needed for making the above judgment. This reduces the overall circuit scale and can therefore realize a low-cost tone generating apparatus.

According to another aspect of the present invention, there is provided a tone generating apparatus comprising wave memory having tone wave data of a half period to be repeatedly read out stored between a loop top address (integer address) and an address preceding by "1" a loop top address (integer address), wherein the same tone wave data that is stored at the loop top address is also stored at the loop end address; address generating means for generating a read address including a fraction portion, which sequentially increases from the loop top address of the wave memory toward the loop end address at an interval corresponding to a pitch, and sequentially decreases toward the loop top address from the loop end address at an interval corresponding to a pitch when exceeding the loop end address; interpolating means for, when the read address generated by the address generating means includes a significant fraction portion, preparing tone wave data acquired by proportional distribution of tone wave data, read out from the wave memory with an integer portion of the read address used as an address, and tone wave data, read out from the wave memory with a value acquired by adding "1" to the integer portion of the read address used as an address, using the fraction portion; and tone generating means for generating a musical tone based on the tone wave data prepared by the interpolating means.

With the above structure, tone wave data of a half period to be repeatedly read out is stored between the loop top address and an address preceding by "1" the loop end address, and the same tone wave data that is stored at the loop top address is also stored at the loop end address. At the time a read address, which sequentially increases from the loop top address of the wave memory toward the loop end address at an interval corresponding to a pitch, and sequentially decreases toward the loop top address from the loop end address at an interval corresponding to a pitch when exceeding the loop end address, is generated, and tone wave data is read out to be interpolated with this read address having a significant fraction portion, it is unnecessary to determine whether or not the read address exists between the loop end address and the address preceding the loop end address by "1" so that interpolation can be executed using the tone wave data stored at integer addresses preceding and following the read address as in the case of carrying out interpolation at another position. Accordingly, the same effect as provided by the first aspect can be acquired. In addition, it is possible to reduce the amount of tone wave data to be repeatedly read out by half.

BRIEF DESCRIPTION OF THE DRAWINGS

FIGS. 6A and 6B are diagrams.

DETAILED DESCRIPTION OF THE PREFERRED EMBODIMENTS

Figure 1:
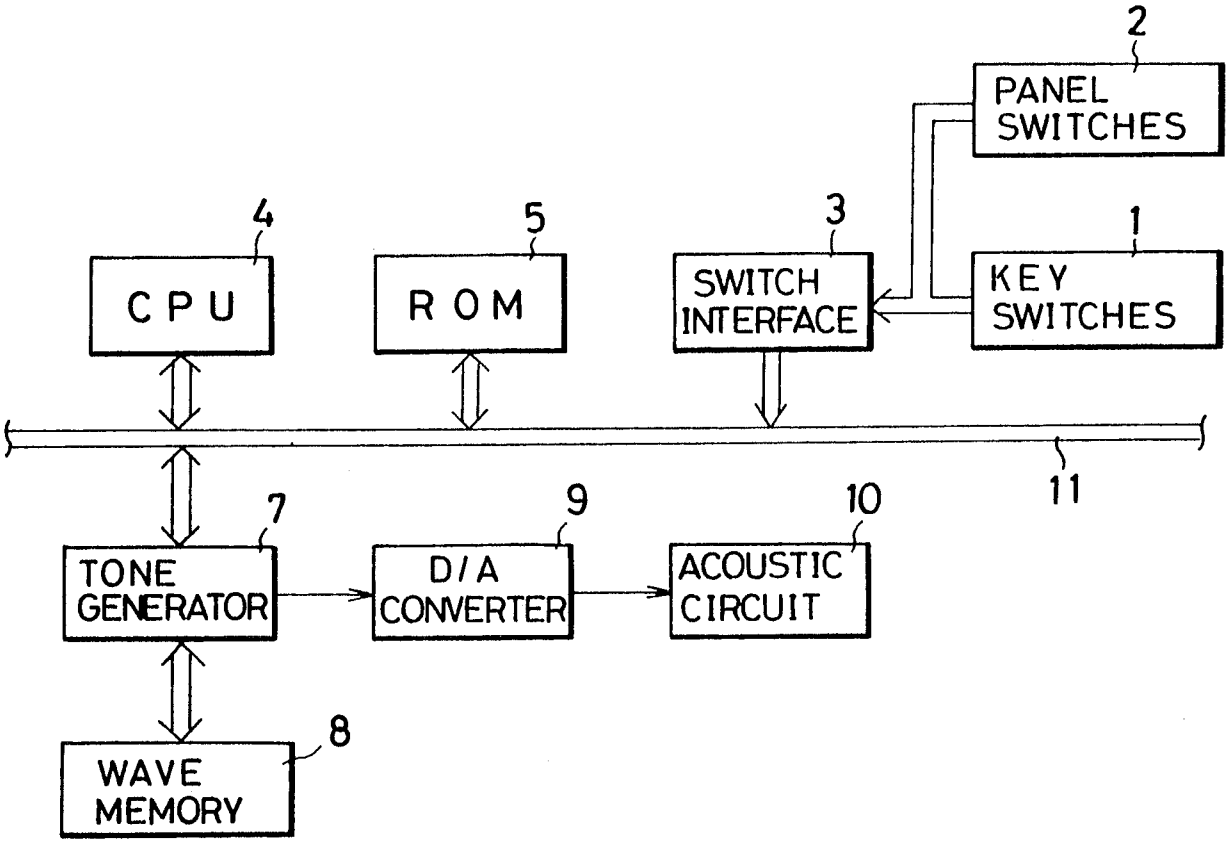
FIG. 1 is a schematic block diagram illustrating the general structure of an electronic musical instrument to which a tone generating apparatus of the present invention is applied.

FIG. 1 is a schematic block diagram illustrating the general structure of an electronic musical instrument to which the tone generating apparatus of the present invention is applied.

Key switches 1 detect whether a player has pressed or released a key, and inform a central processing unit (CPU) 4 of that information. The key switches 1 include multiple keys and a key scan circuit for detecting the depression status of each key. Signals from the key switches 1 are sent to a switch interface 3.

Panel switches 2 include a power switch, a mode designate switch, a melody select switch, a rhythm select switch, etc. The set/reset status of each panel switch is detected by a panel scan circuit included in the panel switches like the key scan circuit in the key switches 1. Signals from the panel switches 2 are also sent to the switch interface 3.

The switch interface 3 outputs data concerning the statuses of the key switches 1 and the panel switches 2, i.e., data for the panel switches in the ON status, a key code and touch data for a key newly depressed, and a key code for a key newly released. The touch data is generated by a well-known touch detector (not shown).

The CPU 4 controls each section of the electronic musical instrument in accordance with a control program which is stored in a program memory section in a read only memory (ROM) 5.

The ROM 5 has a control program for operating the CPU 4 and various fixed data, such as timbre data.

A tone generator 7, directly relating to the feature of the present invention, is connected to a wave memory 8. The tone generator 7 and the wave memory 8 will be described in detail later. A digital ton signal from the tone generator 7 is sent to a D/A (digital-to-analog) converter 9.

The switch interface 3, the CPU 4, the ROM 5 and the tone generator 7 are connected to one another by a system bus 11.

The D/A converter 9 converts a received digital tone signal to an analog signal. The analog signal from the D/A converter 9 is supplied to an acoustic circuit 10.

The acoustic circuit 10 converts the received analog signal as an electric signal into an acoustic signal; this function is realized by, for instance, loudspeakers or a headphone.

Figure 2:
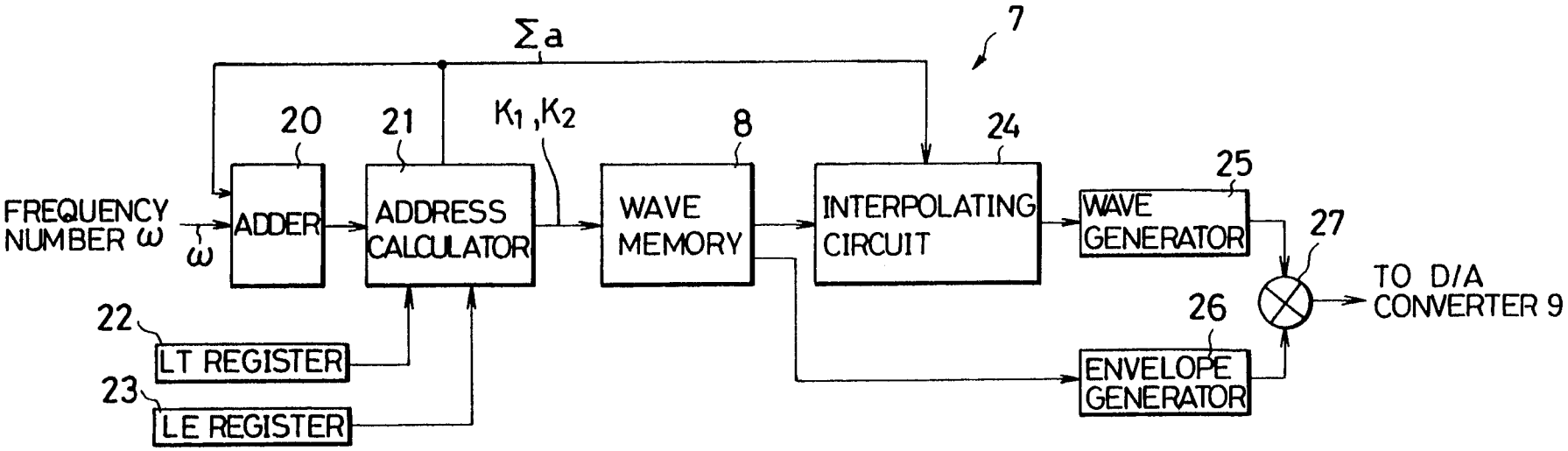
FIG. 2 is a detailed block diagram illustrating a tone generator 7 and a wave memory 8 as one embodiment of the tone generating apparatus of the present invention.

FIG. 2 is a block diagram illustrating the tone generator 7 and the wave memory 8 in the electronic musical instrument in detail.

To begin with, the structure of the tone generator 7 will be described. It is assumed that the wave memory 8 has envelope data stored therein besides the tone wave data.

An adder 20 adds a current read address $\rho a$ stored in an address calculator 21 to a frequency number $\omega$ which is sent from the CPU 4.

The frequency number $\omega$ is data indicating a pitch; more specifically, it is data which designates a sampling interval in the address space of the wave memory 8. This frequency number $\omega$ includes effective numbers below a decimal point.

The result of the addition performed in the adder 20 is supplied again to the address calculator 21 to be stored as the next read address. That is, the adder and the address calculator 21 realize the function of an accumulator.

The address calculator 21 controls the repetitive data reading in accordance with the address values set in an LT register 22 and an LE register 23 as well as stores the next read address calculated in the adder 20 as described above. Specifically, the address calculator 21 performs various address computations as illustrated in the flowcharts disclosed in FIGS. 5, 8 and 10 (which will be described later), and is constituted by a wired logic or a processor.

The read address $\Sigma a$ stored in this address calculator 21 is supplied to the adder 20 and an interpolating circuit 24. Further, an integer portion $K_1$ and an integer address $K_2$ for interpolation of the read address $\Sigma a$ computed in the address calculator 21 are supplied to the wave memory 8. The interpolating integer address $K_2$ is the the integer portion $K_1$ plus "1".

The interpolating circuit 24 proportionally distributes two pieces of tone wave data, namely, a first piece of tone wave data read out from the wave memory 8 using the integer portion $K_1$ of the read address and a second piece of tone wave data read out therefrom using the interpolating integer address $K_2$, in accordance with the fraction portion of the present read address $\Sigma a$, i.e., the circuit 24 performs interpolation of the two pieces of tone wave data. The circuit 24 then supplies the resultant data to a wave generator 25. The interpolating circuit 24 is constituted by a wired-logic or processor which is designed to realize the above function.

The wave generator 25 reproduces a tone waveform based on the tone wave data from the interpolating circuit 24, and generates a tone wave signal. This tone wave signal is in turn supplied to a multiplier 27.

An envelope generator 26 generates an envelope signal based on envelope data read out from the wave memory 8, and supplies it to the multiplier 27.

The multiplier 27 multiplies the tone wave signal from the wave generator 25 by the envelope signal from the envelope generator 26, thus providing a tone signal having the envelope signal added thereto. This tone signal is converted into an analog signal by the D/A converter 9, which is in turn released from the acoustic circuit 10 (see FIG. 1).

A description will now be given of tone wave data to be stored in the wave memory 8.

To clarify how tone wave data is stored in the wave memory 8 and is read out therefrom according to one embodiment of the present invention, the conventional, typical ways of storing tone wave data in the wave memory and reading it therefrom will be described first.

Figure 3:
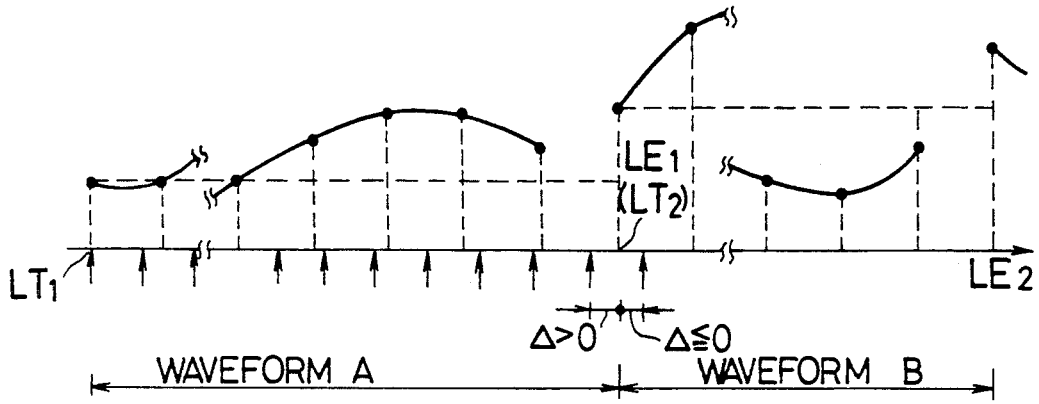
FIG. 3 is a diagram for explaining a typical storing tone wave data to a wave memory and a typical operation for reading the data from the memory, both conventionally performed.

FIG. 3 illustrates that tone wave data (waveforms A and B) is consecutively stored in the wave memory 8. In this diagram, the black dots indicate tone wave data stored in the wave memory 8, the vertical scale representing the level of the data. This tone wave data is stored at an integer address indicated on the horizontal scale.

Of tone wave data of a predetermined length to reproduce a tone waveform with one timbre, that which excludes the attack portion of the musical tone, i.e., the portion to be repeatedly read out, is defined by both the loop top address LT and loop end address LE.

FIG. 3 presents an example in the case where tone wave data consisting only of a tone waveform to be repeated (tone wave data having no attack portion) is consecutively stored. The repetitive reading range for the waveform A is specified by the loop top address $LT_1$ and loop end address $LE_1$, while this range for the waveform B is specified by the loop top address $LT_2$ and loop end address $LE_2$.

In this case, the loop end address $LE_1$ of the waveform A is used only to determine the end of the repetition and actual tone wave data is unnecessary. The loop end address $LE_1$ is therefore defined to be the same address as the loop top address $LT_2$ of the next waveform B and the first tone wave data of the waveform B is stored at this address.

When the contents of the individual addresses are sequentially read out at a predetermined speed from the wave memory 8 where the tone wave data has been stored in the above-described manner, a musical tone with a predetermined pitch can be obtained.

To produce a musical tone having the same timbre but a lower pitch than the predetermined pitch, the same tone wave data is read out at the same speed as the predetermined speed while setting the sampling positions (indicated by "↑" in FIG. 3) narrower than the actual address interval as illustrated. At this time, since the sampling positions do not match with the addresses in the wave memory 8, tone wave data should be calculated through interpolation.

Likewise, to produce a musical tone having the same timbre but a higher pitch than the predetermined pitch, the same tone wave data is read out at the same speed as the predetermined speed while setting the sampling positions wider than the actual address interval, and interpolation is performed to compute tone wave data.

Figure 4:
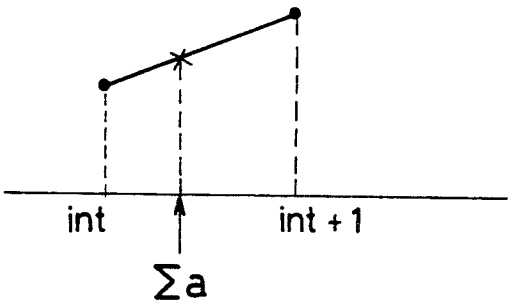
FIG. 4 is a diagram for explaining an interpolation process which is executed both in the conventional tone generating apparatus and the embodiment of the present invention.

FIG. 4 illustrates how to perform the interpolation. More specifically, when the read address Σa which is to be a sampling position includes a significant fraction portion, a value to be the stored content at the read address Σa is calculated in accordance with the difference (inclination) between the stored contents at addresses closest to the read address Σa and indicated by two integers "int" and "int+1" and this value is taken as tone wave data.

Such interpolation is executed in the same manner also in the embodiments of the present invention to be described later.

Figure 5:
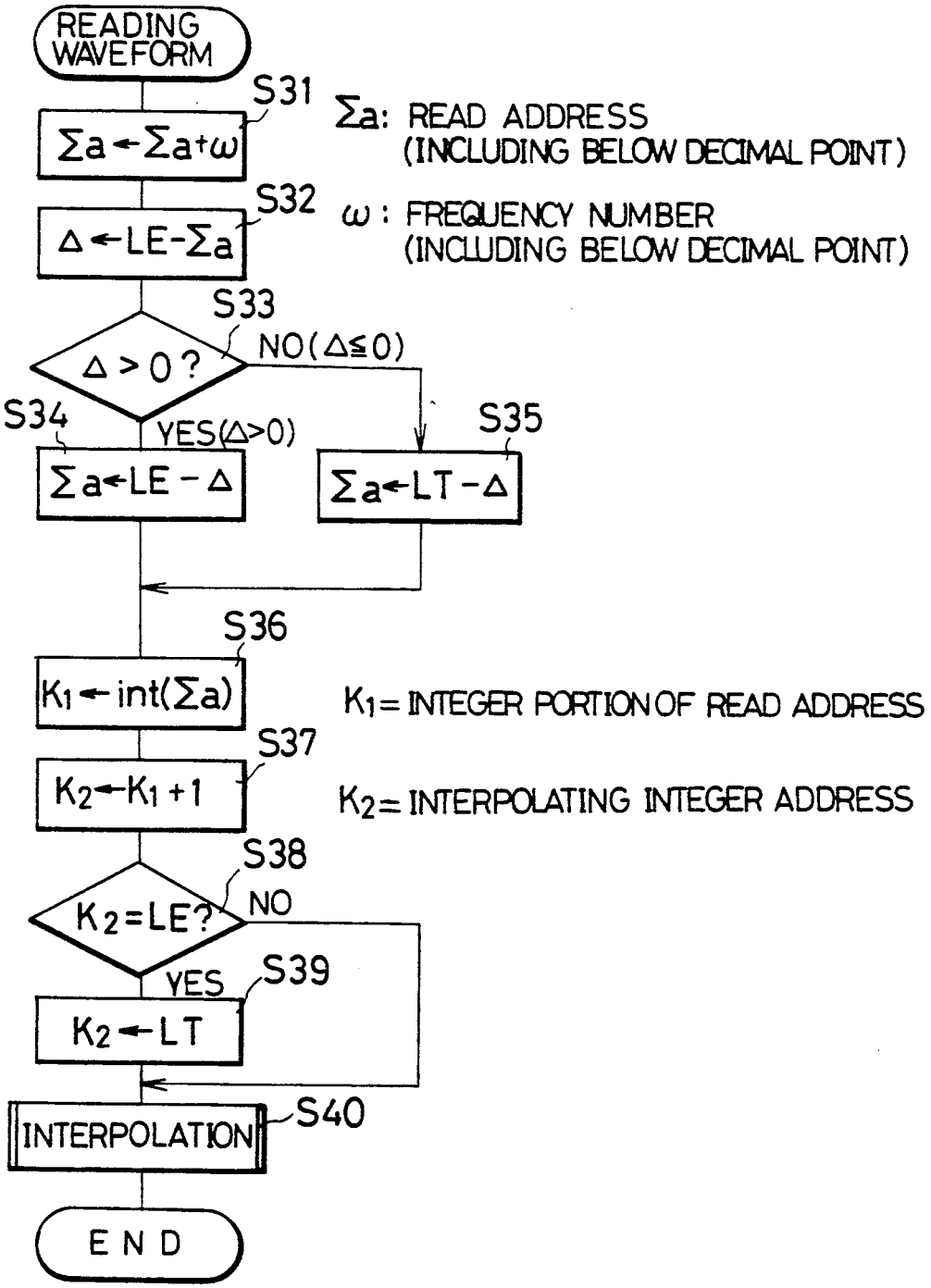
FIG. 5 is a flowchart illustrating a process for reading out tone wave data which is stored in the wave memory in the manner shown in FIG. 3.

FIG. 5 illustrates a flowchart of the operation of a circuit which repeatedly reads out tone wave data stored in the form shown in FIG. 3 while performing interpolation; this circuit is realized by the address calculator 21 and the interpolating circuit 24.

First, the frequency number ω given from the CPU 4 is added to the present read address Σa stored in an internal register (not shown) of the address calculator 21 to calculate the next read address Σa in the adder 20 (step S31). It is to be noted that the read address Σa includes an integer portion and a fraction portion, the former being the read address to the wave memory 8 and the latter used as an offset at the time the interpolation is performed. The frequency number ω also includes a fraction portion, which determines the sampling interval in the address space of the wave memory 8. This sampling interval corresponds to a key number or a pitch.

Then, the next read address Σa is subtracted from the loop end address LE stored in the LE register 23 to acquire a difference Δ (step S32), and it is checked to determine whether or not this difference Δ is greater than zero (step S33). In other words, it is checked to see if the next read address Σa has exceeded the loop end address LE.

If the difference Δ is greater than zero as shown in FIG. 3, or if the sampling position does not exceed the loop end address LE, the difference Δ is subtracted from the loop end address LE to restore the next read address Σa (step S34). If the difference Δ is equal to or smaller than zero, or if the sampling position is beyond the loop end address LE, the difference Δ is subtracted from the loop top address LT, the result taken as the next read address Σa (step S35). Accordingly, the next read address Σa goes or wraps around to the top of the tone wave data with a predetermined offset.

Then, the integer portion of the next read address Σa calculated above is extracted to be an integer portion $K_1$ of the read address (step S36), and "1" is added to this integer portion $K_1$ to be an integer address $K_2$ for interpolation (step S37). It is then determined whether or not the integer address $K_2$ is equal to the loop end address LE (step S38). If they equal each other, which means the present read address Σa is within the range of "$LE-1 \leqq \rho a < LE$", the loop top address LT is used as the integer address $K_2$ (step S39).

Next, the interpolation shown in FIG. 4 is executed (step S40), making it possible to read out consecutive tone wave data from the loop end to the loop top and thus provide a continuous and smooth musical tone.

According to the thus constituted tone generating apparatus, at the time tone wave data is repeatedly read out from the wave memory 8, it is necessary to always check if the integer address $K_2$ for interpolation equals the last address (loop end address LE) and read out tone wave data while changing $K_2$ in such a way that the loop top address LT is used as the integer address $K_2$ when $K_2$ equals LE. That is, the processes indicated by steps S38 and S39 are needed. This therefore requires a comparator to compare the integer address $K_2$ with the loop end address LE and a controller to alter $K_2$ in such a way that the loop top address LT is used as $K_2$ when necessary. This means that the tone generating apparatus is complicated and its circuit scale becomes large.

As a solution to this shortcoming, the present inventor has proposed a tone generating apparatus which adds the same data stored at the loop top address LT to the end of tone wave data when tone wave prepared by cutting off a multi-period tone waveform from the original musical tone is stored in the wave memory 8, and treats the resultant data as the loop end address LE, thus eliminating the need to determine whether the integer address for interpolation has exceeded the loop end address and simplifying the required hardware (refer to Japanese Patent Application No. Hei 2-81187).

According to this tone generating apparatus, even with less hardware and a smaller circuit scale, a sustaining musical tone can be generated by repetitively reading tone wave data corresponding to a multi-period tone waveform from the wave memory. However, only tone wave data prepared by cutting out a multi-period tone waveform which the original musical tone has is disclosed as tone wave data to be stored in the wave memory 8 in the above application.

For electronic musical instruments, it is desired that musical tones be generated based on a tone waveform prepared by artificially synthesizing waveforms. To realize it, normally, tone wave data corresponding to a waveform of a single period or a half period is produced and stored in the wave memory, and at the time of tone generation, this stored tone wave data of a single period or a half period is repeatedly read out, thereby generating a sustaining musical tone.

The present invention pertains to a tone generating apparatus which stores such tone wave data of a single period or a half period in its wave memory and generates a musical tone based on the data.

First Embodiment

To begin with, a description will be given of an embodiment of a tone generating apparatus which stores tone wave data of a single period in advance in the wave memory 8 and repeatedly reads out the tone wave data to thereby generate an associated musical tone.

Figure 6A:
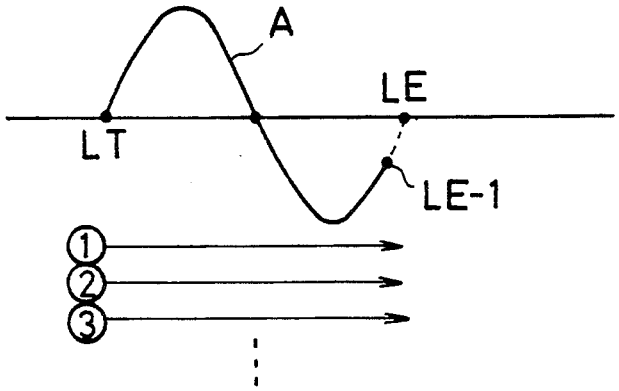
FIGS. 6A and 6B are diagrams exemplifying tone wave data of a single period to be stored in the wave memory of the first embodiment of the present invention.
Figure 6B:
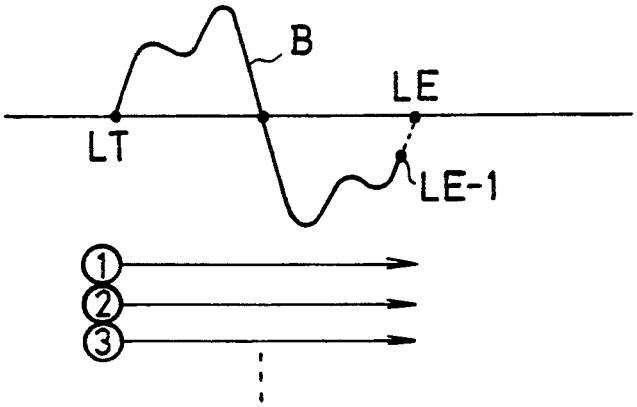

In this case, multiple types of tone wave data for one period synthesized using inverse Fourier transform, for example, are stored in the wave memory 8 as shown in FIGS. 6A and 6B. At this time, the synthesizing of waveform data is executed in such a way that the tone wave data starts from a specific value; these diagrams show waveforms which start from zero as the specific value.

At the time tone wave data is read out for tone generation, it is repeatedly read out in the same direction as indicated by the arrows ①, ②, ③, . . . to generate a sustaining musical tone.

The repetitive reading interval is defined by the loop top address LT and loop end address LE, and tone wave data for one period is stored in a range from LT to "LE−1". Thus, there is no tone wave data stored between LE−1 and LE. Accordingly, the data in the repetitive reading interval is truncated. The same tone wave data stored at LT (zero in FIGS. 6A and 6B is also stored at LE.

Figure 7:
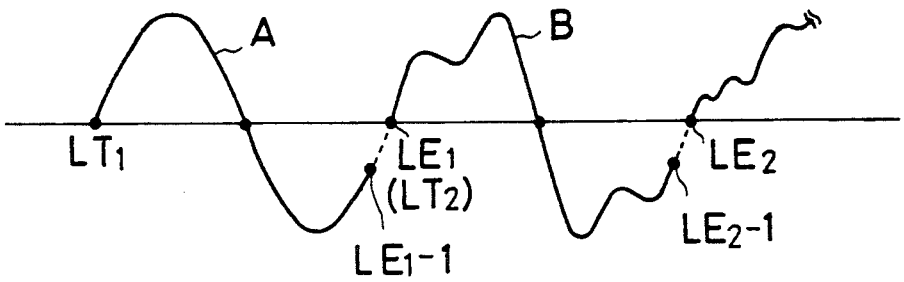
FIG. 7 is a diagram illustrating the storage status of tone wave data to be stored in the wave memory according to the first embodiment of the present invention.

FIG. 7 illustrates that multiple waveforms of a single period tone waveform are stored in the wave memory 8.

The waveform A is specified by the loop top address $LT_1$ and loop end address $LE_1$, while the waveform B is specified by the loop top address $LT_2$ and loop end address $LE_2$. The loop end address $LE_1$ of the waveform A and the loop top address $LT_2$ of the waveform B are assigned to the same address, so that the same data (zero in FIG. 7) is stored at these addresses.

A description will now be given of the operation of the first embodiment having the above-described structure and employing the described way of storing tone wave data.

Figure 8:
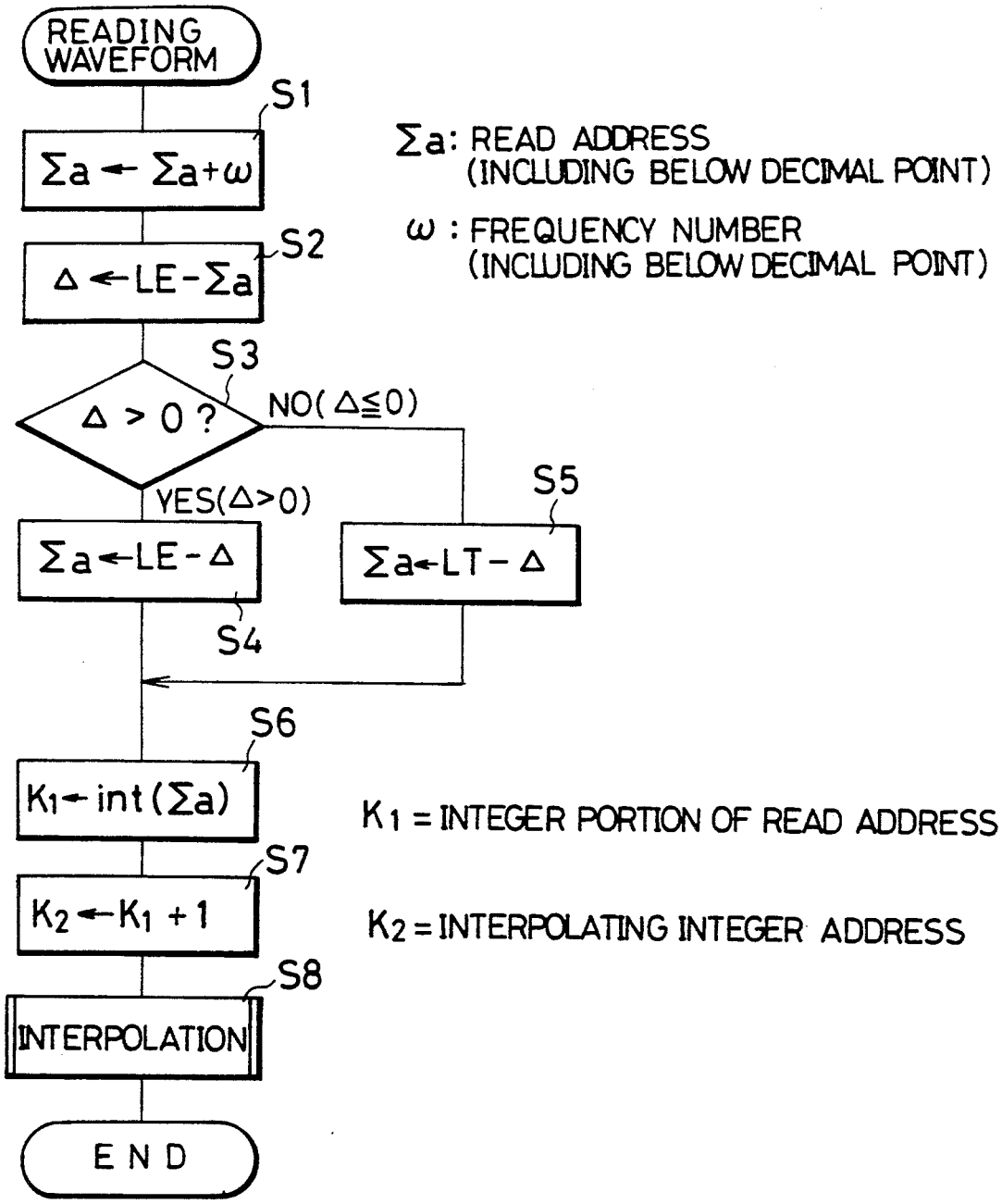
FIG. 8 is a flowchart showing the operation of the first embodiment of the present invention.

FIG. 8 illustrates a flowchart of the operation of a circuit which repeatedly reads out tone wave data of a single period stored in the form shown in FIG. 7 while performing interpolation; this circuit is realized by the address calculator 21 and the interpolating circuit 24.

First, the frequency number $\omega$ given from the CPU 4 is added to the present read address $\Sigma a$ stored in an internal register (not shown) of the address calculator 21 to calculate the next read address $\Sigma a$ in the adder 20 and the address $\Sigma a$ is stored again in the internal register of the address calculator 21 (step S1). The read address $\Sigma a$ includes an integer portion and a fraction portion, as described above, the former supplied to the wave memory 8 as an address to read tone wave data and the latter supplied to the interpolating circuit 24 to be used as an offset at the time the interpolation is performed. As also described earlier, the frequency number $\omega$ includes a fraction portion.

Then, the next read address $\Sigma a$ obtained in step S1 is subtracted from the loop end address LE set in the LE register 23 to acquire a difference $\Delta$ (step S2). It is then checked if this difference $\Delta$ is greater than zero (step S3). In other words, it is checked to determine whether the next read address $\Sigma a$ has exceeded the loop end address LE.

If the difference $\Delta$ is greater than zero, or if the sampling position does not exceed the loop end address LE, the difference $\Delta$ is subtracted from the loop end address LE to restore the next read address $\Sigma a$ (step S4). If the difference $\Delta$ is equal to or smaller than zero, or if the sampling position is beyond the loop end address LE, the difference $\Delta$ subtracted from the loop top address LT, and the result is taken as the next read address $\Sigma a$ (step S5). Accordingly, the next read address $\Sigma a$ goes around to the top of the tone wave data with a predetermined offset.

Then, the integer portion of the next read address $\Sigma a$ calculated in the step S4 or S5 is extracted to be an integer portion $K_1$ of the read address (step S6), and "1" is added to this integer portion $K_1$ to be an integer address $K_2$ for interpolation (step S7).

Next, the interpolating circuit 24 performs interpolation using the present read address $\Sigma a$, the integer portion $K_1$ and the integer address $K_2$ (step S8).

At this time, if the present read address $\Sigma a$ lies within the following range $$Le-1 \leqq \Sigma a \leqq LE \quad (1)$$

then the interpolation is performed using "LE−1" as the integer portion $K_1$ and "LE" for the integer address $K_2$.

Since the same content at LT is stored at LE, however, the interpolation is actually performed using "LE−1" as the integer portion $K_1$ and "LT" as the integer address $K_2$. Accordingly, it is possible to continuously read out tone wave data from the loop end to the loop top and provide a smooth continuous musical tone to be released.

According to the processing shown in FIG. 8 performed by this embodiment as compared with the conventional typical processing shown in FIG. 5, it is apparent that this embodiment does not require the hardware involved in steps S38 and S39 in FIG. 5, more specifically, a comparator to compare the integer address $K_2$ with the loop end address LE and a controller to alter $K_2$ are eliminated in such a way that the loop top address LT is used as $K_2$.

Second Embodiment

A description will now be given of an embodiment of a tone generating apparatus of an alternate processing system, which stores tone wave data of a half period in advance in the wave memory 8 and repeatedly reads out the tone wave data in the alternate address-incrementing direction and address-decrementing direction to thereby generate an associated musical tone.

According to this alternate processing system, it is sufficient to store tone wave data for a half period in the wave memory 8, thus reducing the required capacity of the wave memory 8.

Figure 9:
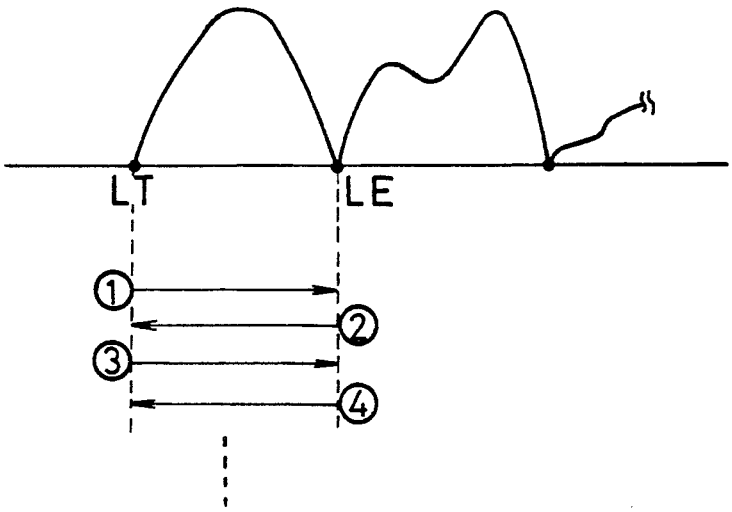
FIG. 9 is a diagram illustrating the storage status of tone wave data to be stored in the wave memory according to the second embodiment of the present invention.

As shown in FIG. 9, multiple types of tone wave data for a half period synthesized using inverse Fourier transform, for example, are stored in the wave memory 8. In this case also, the synthesizing of waveform data is executed in such a way that the tone wave data starts from a specific value; FIG. 9 exemplifies a waveform which start from zero as the specific value.

At the time tone wave data is read out for tone generation, it is read out alternately in different directions as indicated by the arrows ①, ②, ③, ④, . . . to generate a sustaining musical tone. In this case, the stored content is read out as they are in the upward reading (① and ③ in FIG. 9), and it is read out while inverting its sign in the downward reading (② and ④).

Figure 10A:
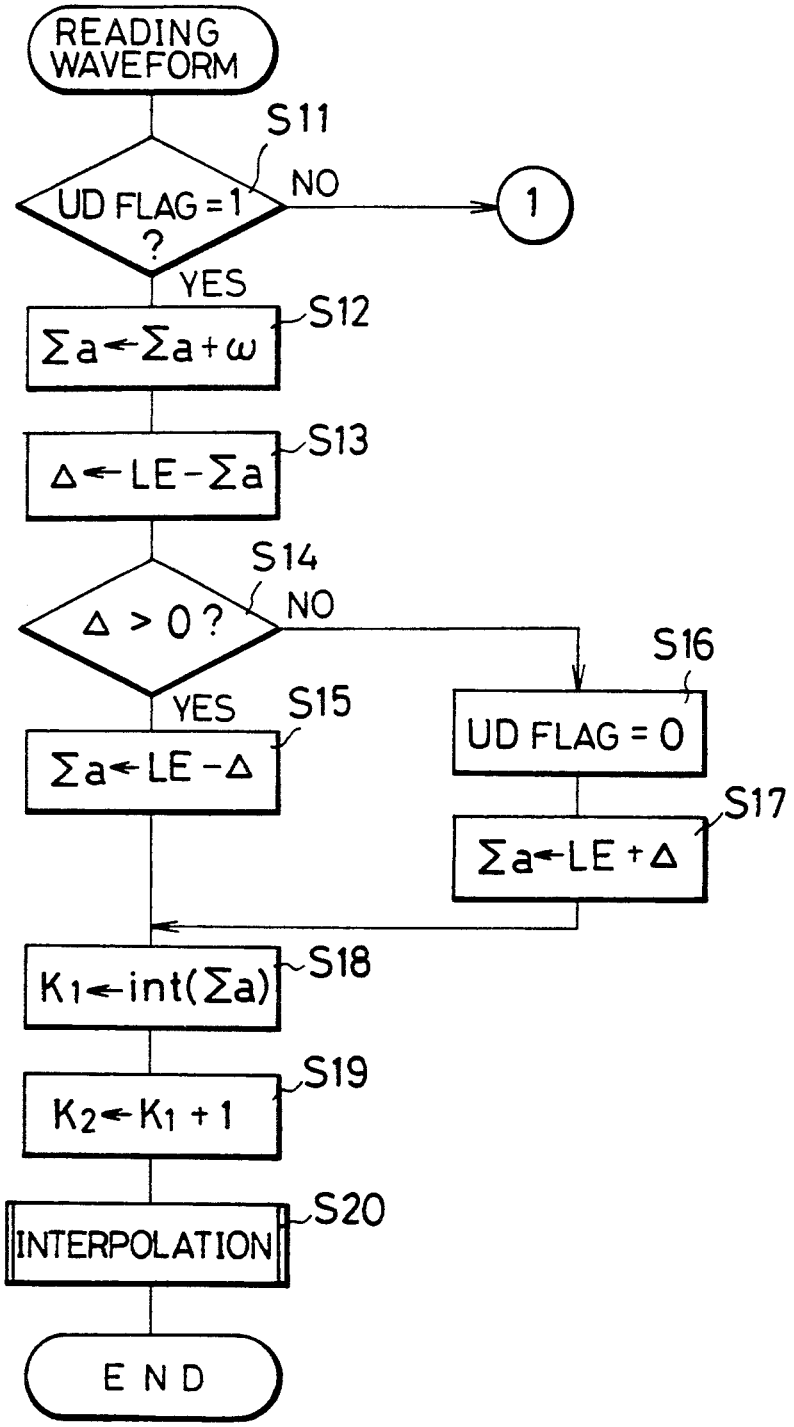
FIGS. 10A and 10B are flowcharts connected to one another by the encircled "1" as indicated showing the operation of the second embodiment of the present invention.
Figure 10B:
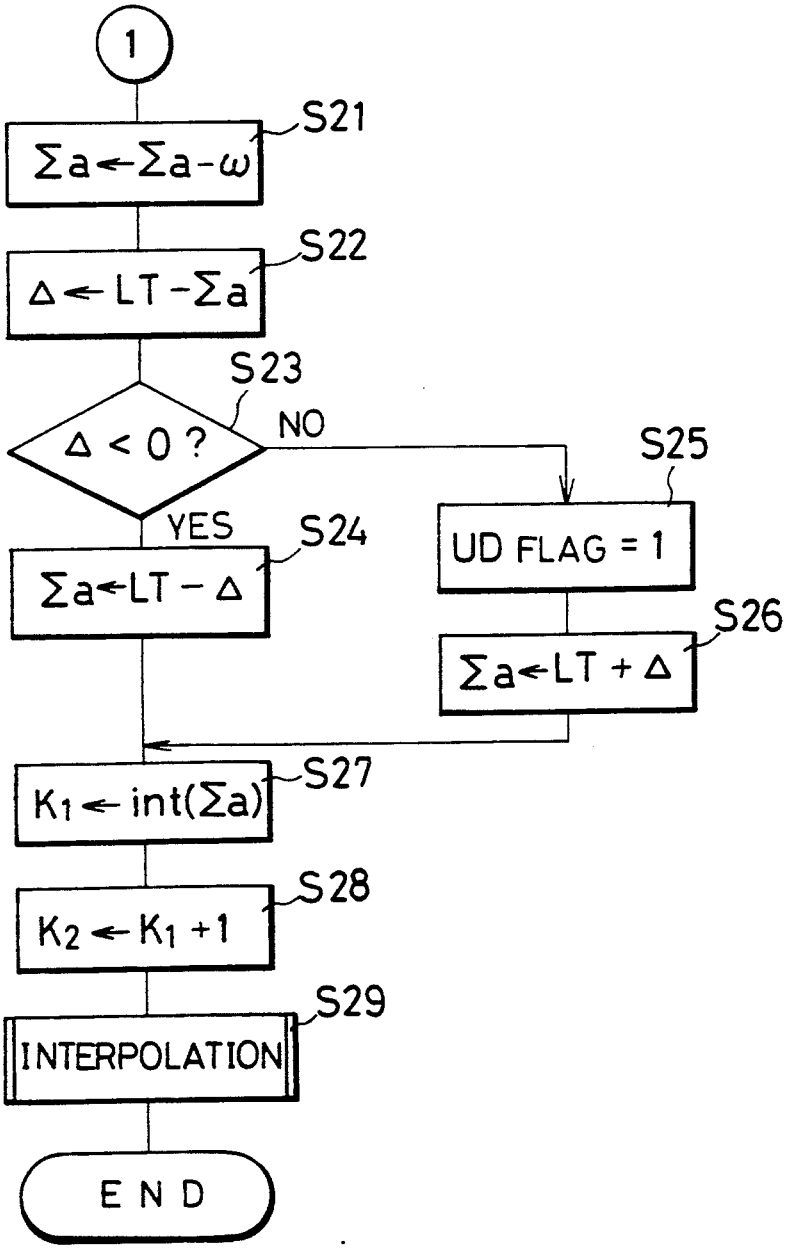

FIGS. 10A and 10B collectively illustrate a flowchart of the operation of a circuit which repeatedly reads out tone wave data of a half period, stored in the form shown in FIG. 9, in the alternate processing system while performing interpolation; this circuit is realized by the address calculator 21 and the interpolating circuit 24.

First, it is checked to determine whether or not a UD flag is "1" (step S11). The UD flag specifies the reading direction: the upward reading or reading from the loop top address LT toward the loop end address LE when it is "1" and downward reading or reading from the loop end address LE toward the loop top address LT when it is "0".

When the UD flag is judged to be "1" in step S11, the upward reading and interpolation as described in steps S12 to S20 start.

First, the frequency number $\omega$ given from the CPU 4 is added to the present read address $\Sigma a$ stored in an internal register (not shown) of the address calculator 21 to calculate the next read address $\Sigma a$ in the adder 20 and the address $\Sigma a$ is stored in the internal register (not shown) of the address calculator 21 (step S12).

Then, the next read address $\Sigma a$ obtained in step S12 is subtracted from the loop end address LE set in the LE register 23 to acquire a difference $\Delta$ (step S13). It is then checked to determine whether or not this difference $\Delta$ is greater than zero (step S14). The difference $\Delta$ is greater than zero, or if the sampling position does not exceed the loop end address LE, the difference Δ is subtracted from the loop end address LE to restore the next read address Σa (step S15). If the difference Δ is equal to or smaller than zero, or if the sampling position is beyond the loop end address LE, the UD flag is set to "0" to subsequently execute the downward reading and interpolation (step S16).

Then, the difference Δ is added to the loop end address LE to provide the next read address Σa (step S17). Since the difference Δ in this case is negative, the next read address Σa will be at the position apart by Δ toward the loop top address LT from the loop end address LE. This next read address Σa becomes the same as the value acquired by adding the frequency number ω to the loop end address LE, if it is considered as a one-period waveform obtained by linking half-period waveforms at point symmetrical positions, i.e., half-period waveforms of opposite phases formed by rotating a half-period waveform 180 degrees around the loop end LE.

Then, the integer portion of the next read address Σa calculated in step S15 or S17 is extracted to be an integer portion $K_1$ of the read address (step S18), and "1" is added to this integer portion $K_1$ to be an integer address $K_2$ for interpolation (step S19).

Next, the interpolating circuit 24 performs interpolation using the present read address Σa, the integer portion $K_1$ and the integer address $K_2$ (step S20).

At this time, if the present read address Σa lies within the formula (1), then the interpolation is performed using "LE−1" as the integer portion $K_1$ and "LE" as the integer address $K_2$.

When the UD flag is judged to be "0" in the aforementioned step S11, the downward reading and interpolation as described in steps S21 to S29 start.

First, the frequency number ω given from the CPU 4 is subtracted from the present read address Σa stored in an internal register (not shown) of the address calculator 21 to calculate the next read address Σa in the adder 20 and the address Σa is stored in the internal register (not shown) of the address calculator 21 (step S21). The read address Σa and frequency number ω both include fraction portions as described earlier.

Then, the next read address Σa obtained in step S21 is subtracted from the loop top address LT set in the LT register 22 to acquire a difference Δ (step S22). It is then checked to determine whether or not this difference Δ is smaller than zero step S23). If the difference Δ is smaller than zero, or if the sampling position does not exceed the loop top address LT, the difference Δ is subtracted from the loop top address LT to restore the next read address Σa (step S24). If the difference Δ is equal to or greater than zero, or if the sampling position is beyond the loop top address LT, the UD flag is set to "1" to subsequently execute the upward reading and interpolation (step S25).

Then, the difference Δ is added to the loop top address LT to provide the next read address Σa (step S26). Since the difference Δ in this case is positive, the next read address Σa will be at the position apart by Δ toward the loop end address LE from the loop top address LT.

Then, the integer portion of the present read address Σa calculated in step S24 or S26 is extracted to be an integer portion $K_1$ of the read address (step S27), and "1" is added to this integer portion $K_1$ to be an integer address $K_2$ for interpolation (step S28).

Next, the interpolating circuit 24 performs interpolation using the present read address Σa. The integer portion $K_1$ and the integer address $K_2$ (step S29).

At this time, if the present read address Σa lies within the following range $$LT \leqq \Sigma a \leqq LT+1 \quad (2)$$

then the interpolating circuit 24 performs the interpolation using "LT+1" as the integer portion $K_1$ and "LT" as the integer address $K_2$.

In the interpolation in the downward direction, the phase of the tone wave data will be inverted, thus providing the same results as provided in the case where a one-period waveform is continuously generated with the loop end address LE taken as the point symmetrical position.

As described above, according to the present invention, the circuit scale for executing interpolation is made smaller, and a low-cost tone generating apparatus is provided.

This invention is clearly new and useful. Moreover, it was not obvious to those of ordinary skill in this art at the time it was made, in view of the prior art considered as a whole as required by law.

It will thus be seen that the objects made apparent from the foregoing description are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A tone generating apparatus, comprising:

a wave memory having tone wave data of a single period to be repeatedly read out, said wave memory being stored only at a loop top address, a loop end address, an address preceding by "1" said loop end address, and at plural integer addresses between said loop top address and said address preceding by "1" said loop end address, and wherein the same tone wave data that is stored at said loop top address is also stored at said loop end address;

address generating means for generating a read address including a fraction portion, which sequentially increases from said loop top address toward said loop end address at an interval corresponding to a pitch, and which returns to said loop top address when said loop end address is exceeded;

interpolating means for, when said read address includes a significant fraction portion, preparing tone wave data acquired by proportional distribution of two pieces of tone wave data, said first piece being read out from said wave memory with an integer portion of said read address used as an address, and said second piece of tone wave data being read out from said wave memory having a value acquired by adding "1" to said integer portion of said read address used as an address, using said fraction portion;

said interpolating means performing interpolation using tone wave data stored at integer addresses preceding and following a read address, and when a read address lies between said loop end address and said address preceding by "1" said loop end address, interpolation is performed using tone wave data stored at said loop end address and said address preceding by "1" said loop end address, said interpolation therefore using the same tone wave data stored at said loop top address and said address preceding by "1" said loop end address because the tone wave data stored at the loop end address is equal to the tone wave data stored at said loop top address; and tone generating means for generating a musical tone based on said tone wave data prepared by said interpolating means;

whereby said tone generating apparatus employs a conventional interpolation circuit; and whereby wave data is calculated by means of said conventional interpolation circuit at a real number read address including a fraction portion, without enlarging the size of said conventional interpolation circuit.

2. A tone generating apparatus according to claim 1, wherein said tone wave data stored in said wave memory is synthesized tone wave data of a single period.

3. A tone generating apparatus according to claim 1, wherein said address generating means comprises a wired logic.

4. A tone generating apparatus according to claim 1, wherein said address generating means comprises a processor.

5. A tone generating apparatus according to claim 1, wherein said interpolating means comprises a wired logic.

6. A tone generating apparatus according to claim 1, wherein said interpolating means comprises a processor.

7. A tone generating apparatus, comprising:

a wave memory having tone wave data of a half period to be repeatedly read out, said wave memory being stored only at a loop top address, a loop end address, an address preceding by "1" said loop end address, and at plural integer addresses said loop top address and said address preceding by "1" said loop end address, and wherein the same tone wave data that is stored at said loop top address is also stored at said loop end address;

address generating means for generating a read address including a fraction portion, which sequentially increases from said loop top address toward said loop end address at an interval corresponding to a pitch, and which sequentially decreases toward said loop top address from said loop end address at an interval corresponding to a pitch when said loop end address is exceeded;

interpolating means for, when said read address includes a significant fraction portion, preparing tone wave data acquired by proportional distribution of two pieces of tone wave data, said first piece being read out from said wave memory with an integer portion of said read address used as an address, and said second piece of tone wave data being read out from said wave memory having a value acquired by adding "1" to said integer portion of said read address used as an address, using said fraction portion;

said interpolating means performing interpolation using tone wave data stored at integer addresses preceding and following a read address, and when a read address lies between said loop end address and said address preceding by "1" said loop end address, interpolation is performed using tone wave data stored at said loop end address and said address preceding by "1" said loop end address, said interpolation therefore using the same tone wave data stored at said loop top address and said address preceding by "1" said loop end address because the tone wave data stored at the loop end address is equal to the tone wave data stored at said loop top address; and tone generating means for generating a musical tone based on said tone wave data prepared by said interpolating means;

whereby said tone generating apparatus employs a conventional interpolation circuit; and whereby wave data is calculated by means of said conventional interpolation circuit at a real number read address including a fraction portion, without enlarging the size of said conventional interpolation circuit.

8. A tone generating apparatus according to claim 7, wherein said tone wave data stored in said wave memory is synthesized tone wave data of a half period.

9. A tone generating apparatus according to claim 7, wherein said address generating means comprises a wired logic.

10. A tone generating apparatus according to claim 7, wherein said address generating means comprises a processor.

11. A tone generating apparatus according to claim 7, wherein said interpolating means comprises a wired logic.

12. A tone generating apparatus according to claim 7, wherein said interpolating means comprises a processor.

* * * * *

UNITED STATES PATENT AND TRADEMARK OFFICE

CERTIFICATE OF CORRECTION

PATENT NO. : 5,146,834

DATED : September 15, 1992

INVENTOR(S) : Gen Izumisawa and Yutaka Washiyama

It is certified that error appears in the above-identified patent and that said Letters Patent is hereby corrected as shown below:

On title page, under Primary Examiner, add the following;

Attorney, Agent, or Firm--Joseph C. Mason, Jr.; Ronald E. Smith--

Signed and Sealed this

Fifth Day of October, 1993

*Attest:*

*Attesting Officer*

BRUCE LEHMAN

*Commissioner of Patents and Trademarks*